United States Patent [19]

Shaw

[11] 3,965,687

[45] June 29, 1976

[54] APPARATUS FOR ANCHORING A STRUCTURE TO THE FLOOR OF A BODY OF WATER

[75] Inventor: Clarence W. Shaw, Metairie, La.

[73] Assignee: J. Ray McDermott & Co., Inc., New Orleans, La.

[22] Filed: Aug. 15, 1974

[21] Appl. No.: 497,629

[52] U.S. Cl. ..... 61/46; 61/53.74; 61/82; 37/57

[51] Int. Cl.[2] ..... E02D 7/24; E02D 27/52

[58] Field of Search ..... 61/46, 46.5, 52, 53.74, 61/82; 37/57; 299/8, 9, 17

[56] References Cited

UNITED STATES PATENTS

| | | | |
|---|---|---|---|
| 1,063,942 | 6/1913 | Phillips | 61/53.74 |
| 3,128,604 | 4/1964 | Sandberg | 61/46.5 |
| 3,263,641 | 8/1966 | Stimson | 61/46.5 X |
| 3,769,803 | 11/1973 | Finney | 61/46.5 |
| 3,839,875 | 10/1974 | Matsushita | 61/53.74 |
| 3,894,771 | 7/1975 | Nezat | 299/8 |
| 3,911,687 | 10/1975 | Mo | 61/46.5 |

FOREIGN PATENTS OR APPLICATIONS

| | | | |
|---|---|---|---|
| 768,484 | 8/1934 | France | 61/53.74 |
| 26,091 | 7/1915 | Norway | 61/82 |

*Primary Examiner*—Paul R. Gilliam
*Assistant Examiner*—David H. Corbin

[57] ABSTRACT

An apparatus for anchoring a structure, such as a drilling platform, to a floor of a body of water has a movable jet nozzle operably disposed in a chamber which is lowered to the floor of a body of water. The jet nozzle is operable to slurry a portion of the floor underlying the chamber, and a pump is provided to evacuate the slurried portion of the floor to provide an excavation into which the apparatus may be lowered. Another pump may depressurize the chamber to provide a pressure differential to hydrostatically urge the apparatus towards the floor of the body of water.

8 Claims, 3 Drawing Figures

APPARATUS FOR ANCHORING A STRUCTURE TO THE FLOOR OF A BODY OF WATER

BACKGROUND OF THE INVENTION

The present invention relates generally to a novel method and apparatus for anchoring a structure to or in the floor beneath a body of water. More particularly, the present invention relates to a method and apparatus for first excavating the material initially lying beneath the apparatus and then by means of hydrostatic pressure maintaining the apparatus in an anchored position in the excavation.

In the past, devices such as derricks or drilling platforms used in offshore oil well drilling operations have been anchored to the subsea floor by different methods and utilizing a variety of apparatus. For example, some derricks of the prior art utilize as an anchoring foot a conical or hemispherical shell, the open end of which is brought to rest on the underlying floor or bed of a body of water. This shell can be utilized as a cement form to mold a concrete foot which provides the primary anchoring structure.

In other instances in the prior art a "sandhogging" operation is utilized. In this sandhogging operation, an inverted shell or caisson is utilized as both a work chamber and as an anchoring foot. There is maintained a sufficient air pressure within the inverted shell or pressure chamber to keep out the water while the dirt or sand from within and at the base of the shell is removed thereby causing the structure to sink into the subsea surface and provide a secure footing.

A variety of problems may exist in these and other methods and apparatus for anchoring a structure to the floor or bed beneath a body of water. For example, in the case of devices which cement the foot to the underlying floor, there may be required relatively complicated excavation devices. Moreover, these devices may not be suitable for use in connection with sea beds having certain compositions. In addition, these types of anchoring footings may not be readily salvageable.

In instances where the sandhogging techniques and apparatus are utilized, buoyancy problems may be encountered when the inverted shell is pressurized or otherwise filled with air. In addition, in many cases a rather complex and costly airlock system may be required in conjunction with the dirt removing apparatus.

Some devices proposed by the prior art suggest an anchor for a drilling platform which is positioned over a desired location and lowered by its own weight into the subsea floor. Hydrostatic pressure is used to provide additional force to drive the anchor into the subsea floor. It is apparent, however, that such devices may have limited usefulness determined by such factors as the composition of the subsea floor.

It is therefore a general object of the present invention to minimize the problems of the type previously noted which exist in the prior art.

A more particular object of the present invention is to provide a novel method and apparatus for anchoring a structure to a floor of a body of water which substantially eliminates the necessity of utilizing shovel-type excavating equipment.

It is another object of the present invention to provide a novel method and apparatus for anchoring a structure to a floor of a body of water which substantially eliminates the necessity of utilizing a cementing operation to achieve a suitable anchor.

It is yet another object of the present invention to provide a novel method and apparatus of anchoring a structure to a floor of a body of water which utilizes a movable jet to excavate the floor beneath a body of water.

It is a further object of the present invention to provide a novel apparatus for anchoring a structure to a floor of a body of water which apparatus utilizes hydrostatic pressure to assist in firmly securing the footing apparatus in position.

SUMMARY OF A PREFERRED EMBODIMENT OF THE INVENTION

According to a preferred embodiment of the invention an apparatus for anchoring a structure to a floor of a body of water is provided having a chamber with a generally downward-facing, continuously open bottom and a pump for selectively reducing or increasing the pressure in the chamber. A jet nozzle is movably disposed in the chamber for dispersing and slurrying the muddy or sandy substances comprising the subsea floor. This slurry is removed in order to excavate the material beneath the chamber and provide a means for at least partially burying the chamber in the subsea floor. The pump may be operated to reduce the pressure in the chamber relative to the hydrostatic pressure acting on the exterior of the chamber to provide an additional force tending to urge the chamber towards the subsea floor.

When it is desired to remove the anchoring foot provided by this embodiment of the apparatus of the present invention, the pump may be operated to reverse its flow to effectively pressurize the interior of the chamber relative to the outside to facilitate removing the embedded foot from the floor material. Additional flotation may be attached to the apparatus to further assist in the removal operation.

BRIEF DESCRIPTION OF THE DRAWINGS

Further and additional objects and advantages of the present invention will become apparent to those skilled in the art when considered in connection with the accompanying drawings wherein like elements have been given like numbers, in which.

DETAILED DESCRIPTION OF A PREFERRED EMBODIMENT OF THE INVENTION

Figure 1:
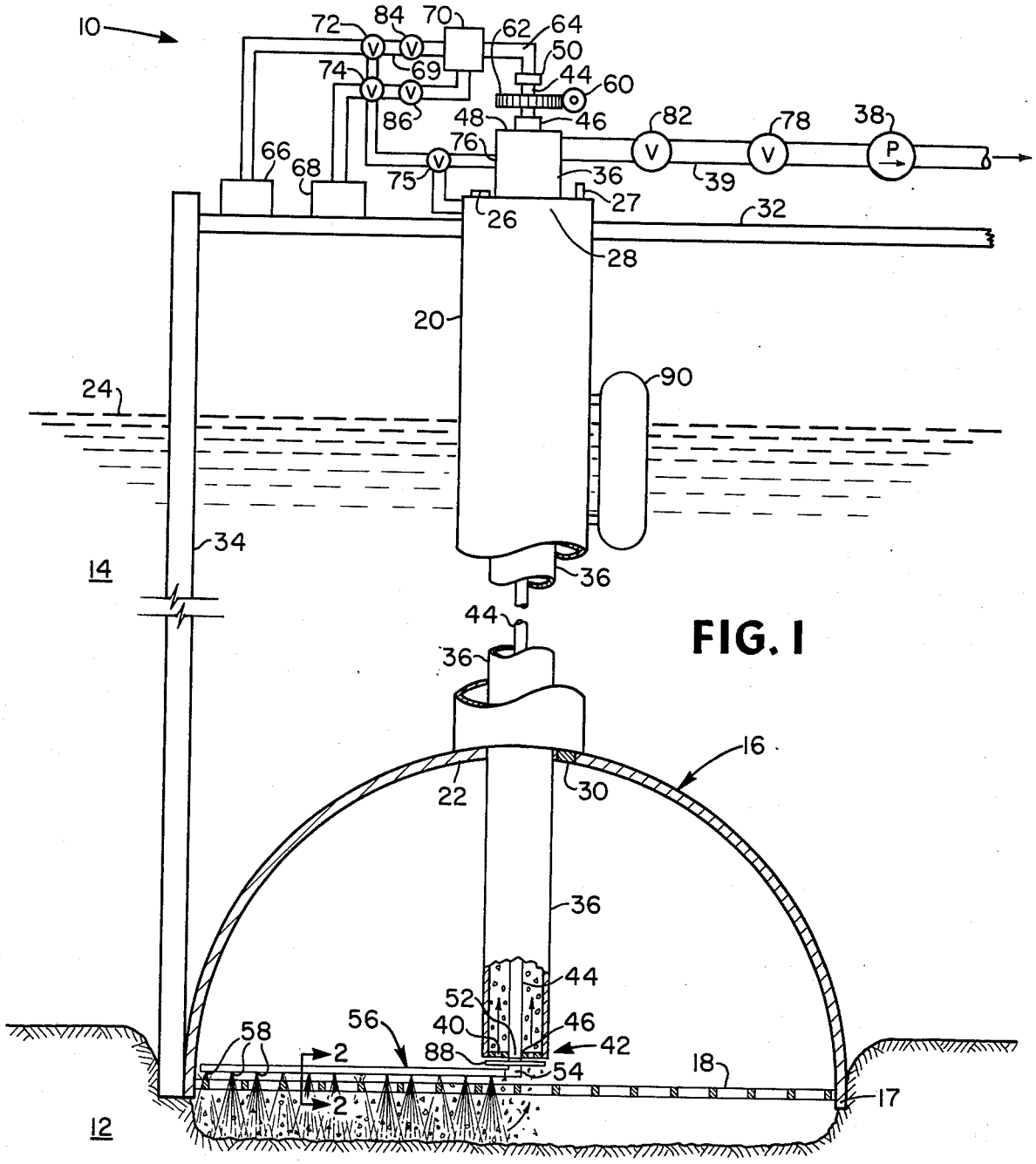
FIG. 1 is a schematic fragmented partial-section of an embodiment of the present invention wherein the floor of the body of water has been partially excavated and said apparatus is partially embedded therein.
Figure 3:
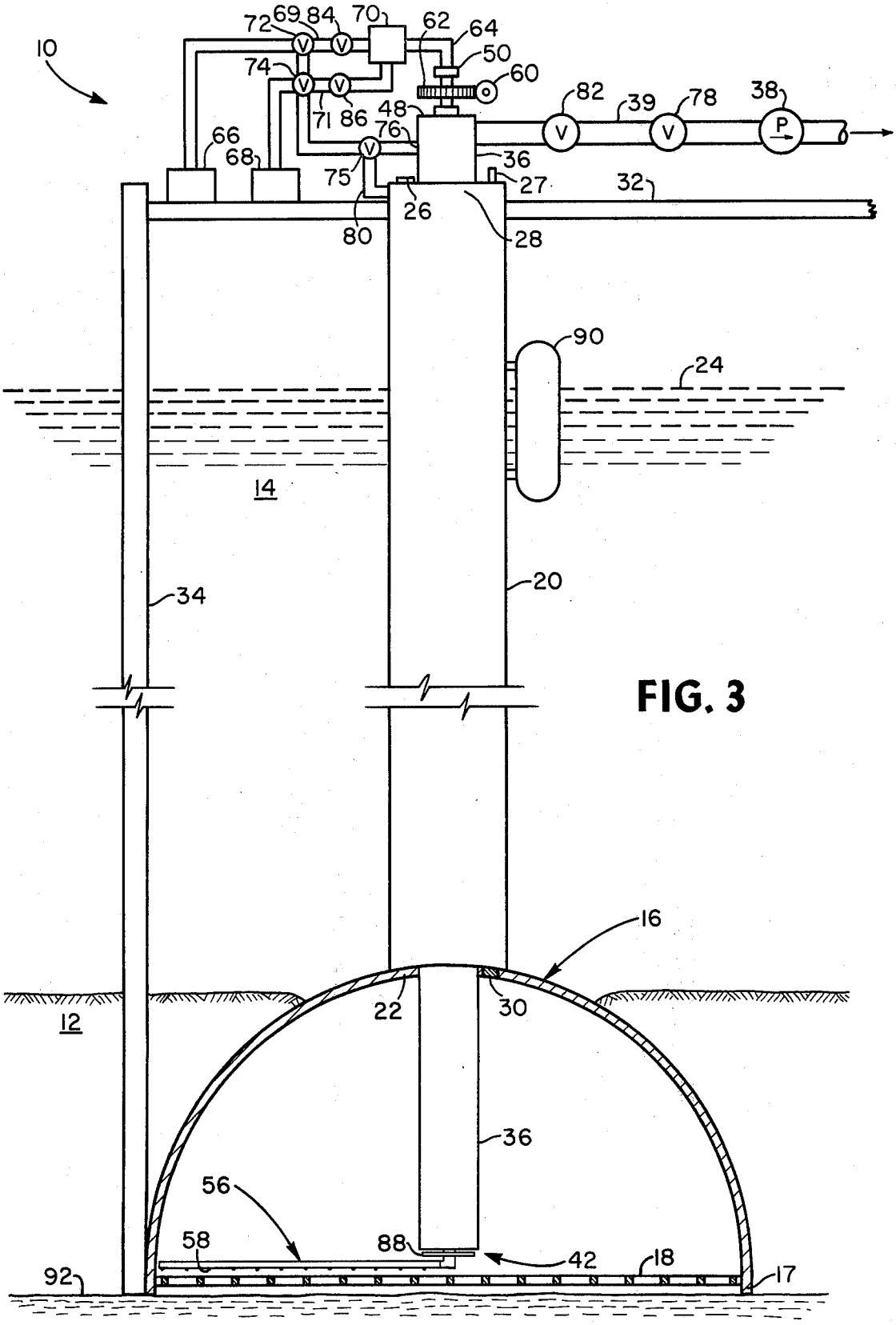
FIG. 3 is a schematic fragmented partial-sectional view of the apparatus of FIG. 1 wherein the excavation is completed and the apparatus is resting on a stable substrata in the floor of the body of water.

As may be seen in FIGS. 1 and 3, an apparatus 10 for anchoring a structure to a floor 12 of a body of water 14 is schematically depicted. A generally hemispherical shell or dome or chamber 16 is utilized as the primary anchoring element of the apparatus. This shell 16 may have a variety of geometries, e.g., a conical or frusto conical shell might be employed. Generally the shell will be fluid impermeable and constructed of structural material such as reinforced steel, concrete or other appropriate materials. The shell 16 is downwardly-facing in that a circular edge 17 defines a plane generally parallel to the plane of the subsea floor. The shell 16 has a grating or a grid 18 which may be comprised of a steel grate having openings sufficient to permit the substantially unimpeded flow of water and slurry but which prevents an ingress of large debris and rocks.

A caisson 20 is fixedly attached to a top portion 22 of the shell 16 and extends from the shell 16 a sufficient distance to extend above the surface 24 of the body of water 14. An upper hatch 26 and vent 27 may be provided at a top portion 28 of the caisson 20 to permit access and venting respectively to the interior thereof. Similarly, a lower hatch 30 may be provided in the top portion 22 of the dome or shell 16 at a location interior of the caisson 20 to permit access through the caisson 20 to the interior of the shell.

A platform 32 may be conventionally attached to the caisson 20. This platform 32 may be further supported by a plurality of pile jackets or conductors, one of which is shown at 34.

Disposed within the caisson 20 is a discharge conduit 36 which extends in preferred form from the platform 32 through the entire length of the caisson 20 and into the shell 16 to a location above the grate 18. A conventional fluid pump 38 may be provided in a mud evacuation line 39 to produce a negative pressure at apertures 40 in a mouth portion 42 of the discharge conduit 36. As will be more fully appreciated below, other factors may contribute to the evacuation action of the discharge conduit 36.

As may be seen in FIG. 1, a rotatable shaft 44 is arranged substantially coaxially with respect to the discharge conduit 36. Appropriate bearings 46 are affixed to the discharge conduit 36 at least at the mouth portion 42 and a top portion 48 of the discharge conduit 36. A rotary coupling 50 of conventional design is provided at the top portion 48 of the discharged conduit. This rotatable shaft 44 may be a water pipe which communicates at its lower end 52 by means of an appropriate joint 54 with a rotatable jet bar or rotor 56. This rotatable jet bar 56 has a plurality of jet nozzles 58 disposed along its length.

Figure 2:
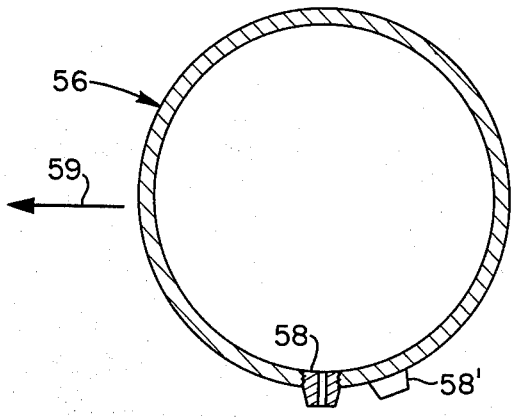
FIG. 2 is a cross-sectional view through section line 2—2 shown in FIG. 1 depicting the placement of nozzles on the jet bar.

With reference now to FIG. 2, there is shown a cross-section of the rotatable jet bar 56. The jet nozzles 58 may be alternately directed downwardly (58) and obliquely (58') as shown. This arrangement of nozzles provides a thrust having a component force in the direction indicated at 59. This force operates to augment the rotation of the jet bar 56.

Of independent significance is an advantageous cooperation between the jet bar 56 and the grate 18 which may assist in providing uniform excavation of a portion of the floor 12 lying beneath the shell 16. This feature will be more particularly described below.

The rotatable jet bar 56 is arranged to rotate in a plane substantially parallel to the plane of the floor of the body of water. It will be appreciated that the travel path or displacement of the jet bar 56 may assume a variety of geometries. For example, it is contemplated that the jet bar could have substantial vertical displacement during rotation. In addition, the jet bar 56 could be arranged to oscillate over a desired portion of the floor where required by a particular composition of the floor. Whereas the embodiment depicted is preferred, other arrangements of a moving jet nozzle may be utilized.

The rotatable shaft 44 may be rotated by an appropriate motor 60 driving a conventional gear arrangement 62 (FIGS. 1 and 3). It will be appreciated that rotation of the jet bar 56 will occur as a result of the combined effect of the motor 60 and the thrust produced by the obliquely positioned jet nozzles 58'.

Pressurized fluid is introduced into the rotatable shaft or water pipe 44 at the rotary coupling rotatable shaft or water pipe 44 at the rotary coupling 50 by means of high pressure conduit 64. This high pressure fluid is provided by an air compressor 66 and a jet water pump 68 schematically shown. The output of the air compressor 66 and of the jet water pump 68 are directed by means of pipes or conduits 69 and 71 respectively to a mixer 70. The output of the mixer 70 is fed to the rotary coupling 50 by means of the high pressure conduit 64.

A back flush or flood system is provided in conjunction with the present apparatus. In this connection, a conventional three-way valve 72 is provided between the output of the air compressor 66 and the input of the mixer 70. A conventional four-way valve 74 is provided between the output of the jet water pump 68 and the input of the mixer 70. By means of these valves 72 and 74 pressurized fluid may be diverted away from the mixer 70 and directed through another conventional three-way valve 75 to a back flush input 76 on the discharge conduit 36.

A back flush valve 78 is provided in the mud evacuation line 39 of the discharge conduit 36 as shown in FIGS. 1 and 3. With the back flush valve 78 in the evacuation line 39 closed, pressurized water may be directed into the back flush input 76 of the discharge conduit 36 to reverse the usual flow of fluid (ordinarily from the mouth 42 to the evacuation line 39) and hence flush any debris in the discharge tube 36 out the mouth 42.

An overpressure safety valve 82 of conventional design may be utilized in the evacuation line 39 in order to maintain at safe levels pressures within the discharge conduit. Similarly, conventional safety valves 84 and 86 may be utilized in connection with the respective air line 69 and the water line 71.

As mentioned above, there are provided at the mouth of the discharge tube a plurality of input ports 40 (FIG. 1). A cutting arm or element 88 is attached to the rotatable water pipe 44 between the jet bar 56 and the input ports 40. This cutter element 88 is situated in such a manner as to break apart any spoil or clumps of soil small enough to pass through the grid 18 and serves to facilitate discharge of the spoil and minimize the possibility of fouling the discharge conduit 36.

As may be seen in FIGS. 1 and 3, a temporary flotation device 90 may be attached to the caisson 20. This flotation device 90 may take the form of a plurality of tanks which may be either filled with fluid, say, mud, or emptied by suitable conventional means (not shown) depending upon the buoyancy of the apparatus desired.

In operation, the apparatus 10 may be carried or floated to a desired location in a conventional manner. The temporary flotation device 90 may be utilized to provide the appropriate buoyancy of the apparatus in accordance with the method used to convey the apparatus 10 to the desired location. When the apparatus 10 has been positioned over the location at which it is desired to anchor the apparatus, piles (not shown) may be driven into the floor of the body of water to guide the apparatus 10 in its downward movement. The buoyancy of the apparatus may then be adjusted to cause the apparatus to settle. The air compressor 66 and the jet water pump 68 may be activated (with the valves 72, 74, 75 and 78 in the appropriate mode) to force the pressurized water and air through the rotary coupling 50 and along the length of the rotatable water pipe 44 to the rotatable jet bar 56. At approximately the same time pressurized water is fed into the water pipe 44, the motor 60 is activated to begin the rotative action of the jet bar 56. As noted above, the jet action of the nozzles 58 significantly contributes to the rotation of the jet bar 56. It will, of course, be appreciated that a plurality of jet bars may be utilized in the practice of the present invention.

When the jet bar 56 rotates with the water jet activated, the unstable sea floor mud below the grid may be broken up by the impact of the pressurized fluid emitted by the nozzles 58, and a slurry may be formed which may be removed through the discharge conduit 36 to a spoil area (not shown).

This jet action of the fluid being discharged by the rotatable jet bar 56 provides a zone of excavation of the generally permeable, unstable strata comprising the upper layer of the floor 12 beneath the shell 16 and into which the shell may sink or otherwise penetrate. The cooperation between the grid 18 and the rotating jet bar 56 may provide an advantageously uniform excavation of the floor. The grid will have a tendency to prevent the shell 16 from sinking further until the entire zone beneath the grid has been slurried. As noted earlier, the spoil liquid or slurry created below the shell 16 by the action of the rotatable jet bar 56 may be removed as a result of a variety of forces. As a result of the high pressure fluid introduced by the jet bar, the water pressure in the shell is relatively higher than the pressure at the mouth of the discharge tube, and, a pump in the evacuation line 39 may further reduce this pressure, with a result that the slurry flows towards the mouth 42 of the discharge tube.

The evcavation action of the apparatus 10 continues until a nonpermeable stable substrata 92 is encountered at which point the apparatus 10 may stop sinking and come to rest on the substrata 92.

Once the apparatus has come to rest on the more stabe substrata 92, the air compressor 66 and the jet water pump 68 may be shut down, and the gear motor 60 may stop driving the rotatable jet bar 56. However, a suction may continuously be imposed at the mouth 42 of the discharge tube 36 in order to create a pressure differential across the shell 16. This pressure differential would result in a force tending to urge the shell 16 against the stable substrata 92 to thereby provide an improved anchoring action for the apparatus 10. In addition, mud and/or sand may fill over the excavated portion of the floor and essentially bury at least a portion of the shell 16 to further contribute to the anchoring action.

When it is desired to remove and salvage the apparatus 10, the interior of the shell 16 may be completely flooded and pressurized by back flushing the discharge conduit 36 to assist in breaking loose the shell from the substrata on which it rests and from the mud and/or sand which would have covered the shell 16. In addition to pressurized fluid introduced into the shell 16, the temporary flotation devices 90 may be pumped empty to provide yet additional buoyancy to raise the apparatus 10 to the surface 24 of the body of water 14. Furthermore, the apparatus could be hydraulically jackedup from the floor by apparatus not shown.

Whereas a preferred embodiment of the method and apparatus of the present invention are shown and described herein, it is to be understood that the invention is not intended to be limited thereby but rather to encompass other embodiments falling within the scope and spirit thereof.

What is claimed is:

1. Apparatus for anchoring a structure to the floor of a body of water comprising:

a generally dome-shaped chamber having an open bottom and constructed of a fluid impermeable structural material which is non-collapsible under a pressure differential created when a suction is applied to the inside of said chamber;

a tubular caisson member fixedly attached to a top portion of the chamber and extending therefrom to a point above the surface of the body of water;

a plurality of fluid jet nozzles rotatably mounted in said chamber and aligned with the axis of said caisson member to direct a plurality of fluid jets generally in a direction of the open bottom of said chamber and generally perpendicular thereto;

displacement means operable when pressurized fluid is emitted from the nozzles for moving said nozzles with respect to said chamber and in a plane generally parallel to a plane of the floor of the body of water to slurry a portion of the unstable mud on the floor of the body of water lying beneath said open bottom and provide a zone of the floor into which said shell may penetrate;

a discharge conduit disposed within said caisson member for removing the slurried material from within the chamber;

a grate extending across the entirety of the open bottom of the chamber and having openings such that said grate acts in cooperation with said displacement means to filter and break apart slurried material entering said chamber to prevent clogging of said conduit while at the same time acting to prevent the chamber from penetrating into the floor before the entire zone beneath said chamber has been slurried; and evacuation means for selectively evacuating said chamber to provide a differential pressure between said chamber and the surrounding body of water to urge said chamber towards the floor of the body of water.

2. The anchoring apparatus of claim 1 wherein said evacuation means is further operable to urge the slurry through said conduit.

3. The anchoring apparatus of claim 1 wherein said shell comprises a generally hemispherical body.

4. The anchoring apparatus of claim 1 wherein said displacement means comprises an elongate rotor.

5. The anchoring apparatus of claim 4 wherein said rotor comprises at least one nozzle aligned to provide a thrust in a direction of rotation of said rotor.

6. The apparatus of claim 1, further comprising:

cutting means proximate the entry to said conduit for breaking apart the slurried material entering said conduit to prevent clogging of said conduit.

7. The anchoring apparatus of claim 1, wherein said evacuation means is further operable to pressurize and flood the shell to assist in urging said shell from the floor of the body of water.

8. Apparatus for anchoring a structure to the floor of a body of water, comprising:

an elongate member having a chamber on one end, said chamber having an open bottom and extending beyond the periphery of said elongate member;

nozzle means disposed within the chamber and aligned to direct jets of pressurized fluid generally in a direction of the open bottom;

an elongate rotor mounted within the chamber for moving said nozzle means with respect to the chamber in such manner as to cause the pressurized jets of fluid to traverse substantially the entirety of the area of the open chamber bottom;

a discharge conduit disposed substantially coaxially with said elongate member for removing the material slurried by the action of said pressurized fluid jets from within the chamber and transporting the material to the surface;

a cutting arm attached to said elongate rotor proximate the entry to said discharge conduit for breaking apart the slurried material produced by the action of said fluid jets in order to prevent clogging of said discharge conduit;

a grate extending across the entirety of the open bottom of the chamber and having openings such that said grate acts in cooperation with said nozzle means to filter and break apart slurried material entering said chamber to prevent clogging of said conduit while at the same time acting to prevent the chamber from penetrating into the floor before the entire zone beneath said chamber has been slurried; and a suction pump for selectively depressurizing the chamber to provide a differential pressure between the chamber shell and the surrounding body of water to urge said elongate member towards the floor of the body of water and hold said elongate member in place.

* * * * *